United States Patent [19]

Wilson et al.

[11] 3,982,373

[45] Sept. 28, 1976

[54] STANDING RIB ROOF

[75] Inventors: Lyle L. Wilson; Robert N. McDonald; Richard W. Mullin; Durwood E. Graddy, all of Eufaula, Ala.

[73] Assignee: American Buildings Company, Eufaula, Ala.

[22] Filed: May 22, 1975

[21] Appl. No.: 580,053

[52] U.S. Cl. ..... 52/588; 52/522; 52/528

[51] Int. Cl.[2] ..... E04D 1/00

[58] Field of Search ..... 52/588, 578, 582, 584, 52/75, 78, 489, 522, 528, 529

[56] References Cited

UNITED STATES PATENTS

| | | | |
|---|---|---|---|
| 3,312,028 | 4/1967 | Schroyer | 52/588 X |
| 3,462,906 | 8/1969 | Schroyer | 52/588 X |
| 3,479,073 | 11/1969 | Cullins | 52/588 X |
| 3,481,094 | 12/1969 | Taylor | 52/522 X |
| 3,641,729 | 2/1972 | Irvin | 52/588 X |
| 3,898,783 | 8/1975 | Matlock et al. | 52/588 X |

*Primary Examiner*—J. Karl Bell

*Attorney, Agent, or Firm*—Jones, Thomas & Askew

[57] ABSTRACT

A standing rib roof structure made up of a plurality of panels joined along adjacent edges, the adjacent edges each being formed as half a standing rib so that the seam between each adjacent pair of panels becomes a standing rib, each edge having a locking means thereon, one edge having a female locking member and the opposite edge having a male locking member that is lockable to the female locking member by being received therein, and a panel clip for fixing the panels to a building, the panel clip being receivable between the male locking member and the female locking member, and having a base for securing the clip to the building.

7 Claims, 8 Drawing Figures

STANDING RIB ROOF

This invention relates to roof structure, and is more particularly concerned with a sheet metal roof structure having a standing rib for interlocking adjacent panels.

It is common practice in commercial buildings and numerous outbuildings and the like to provide a roof by simply placing a plurality of interlocking metal panels directly against the framing of the building, i.e., sheet metal panels are placed directly on the purlins of the building and are fixed thereto. In providing such a roof structure, it will be recognized that it is important first to have the seams between adjacent panels completely watertight, and it is of course desirable to provide the watertight seam between panels in as economical a manner as possible. Moreover, it is desirable to use a relatively lightweight metal for the sheet metal panels, so it is necessary to provide some form of reinforcement to provide the required strength, and a standing rib has commonly been used to lend strength to the panels while forming a watertight joint between adjacent panels.

The seam in adjacent panels of a standing rib roof normally provides the functions of sealing adjacent panels together with a watertight seam, lending mechanical strength to the sheet metal panels, and securing the sheet metal panels to the structural members of the building on which the roof is installed. Prior art standing rib roof structures have generally performed these three functions, but there have been certain drawbacks to the prior art structures. One of the difficulties with the prior art roof structures is that the standing rib seam between adjacent panels tends to be either extremely difficult to form in the first place, or extremely easy to pull apart. In other words, a seam that is easy to put together tends to be almost equally easy to pull apart, and seams that are quite secure and difficult to pull apart are almost equally difficult to put together, frequently requiring heavy machinery for turning seams and rolling metal and the like during the installation of the panels on a structure.

The roof structure of the present invention overcomes the above-mentioned and other difficulties with the prior art roof structure by providing a standing rib roof structure including a panel having one edge thereof formed as a male locking member and the other edge formed as a female locking member so that any two like panels can be joined along an entire edge. In conjunction with the roof panel, there is a panel clip that is provided to interlock with the locking members and to be attached to the structure of the building to which the roof is to be attached. The preferred form of panel clip is formed as a hermaphroditic locking member so that the panel clip receives the male locking member of one roof member and then receives the female locking member of an adjacent roof panel so clips can be placed along the seam as desired or needed. The entire locking structure is such that it can be snapped together simply by exerting force on the top of the female locking member of a panel, and this force can generally be provided manually, as by means of a rubber mallet or the like. Since the panel clip is hermaphroditic in structure, it will be understood that either edge of the panel, that is, either the male locking member or the female locking member, can be used to lock with the panel clip without the presence of the opposite edge of a panel member for attaching the two extreme edges of the roof structure to the building. Due to the particular arrangement of the roof structure of the present invention, it will be seen that the roof is very simple to install, and the roof structure is strong, durable, watertight, and is quite easy to trim both at the edges and at the ridge of the roof to render the roof completely waterproof. While the roof of the present invention is adapted for use in metal buildings, it will be understood by those skilled in the art that the roof panels and the panel clips are adaptable to use on conventional wood framing and other buildings.

These and other features and advantages of the present invention will become apparent from consideration of the following specification when taken in conjunction with the accompanying drawings in which.

Figure 1:
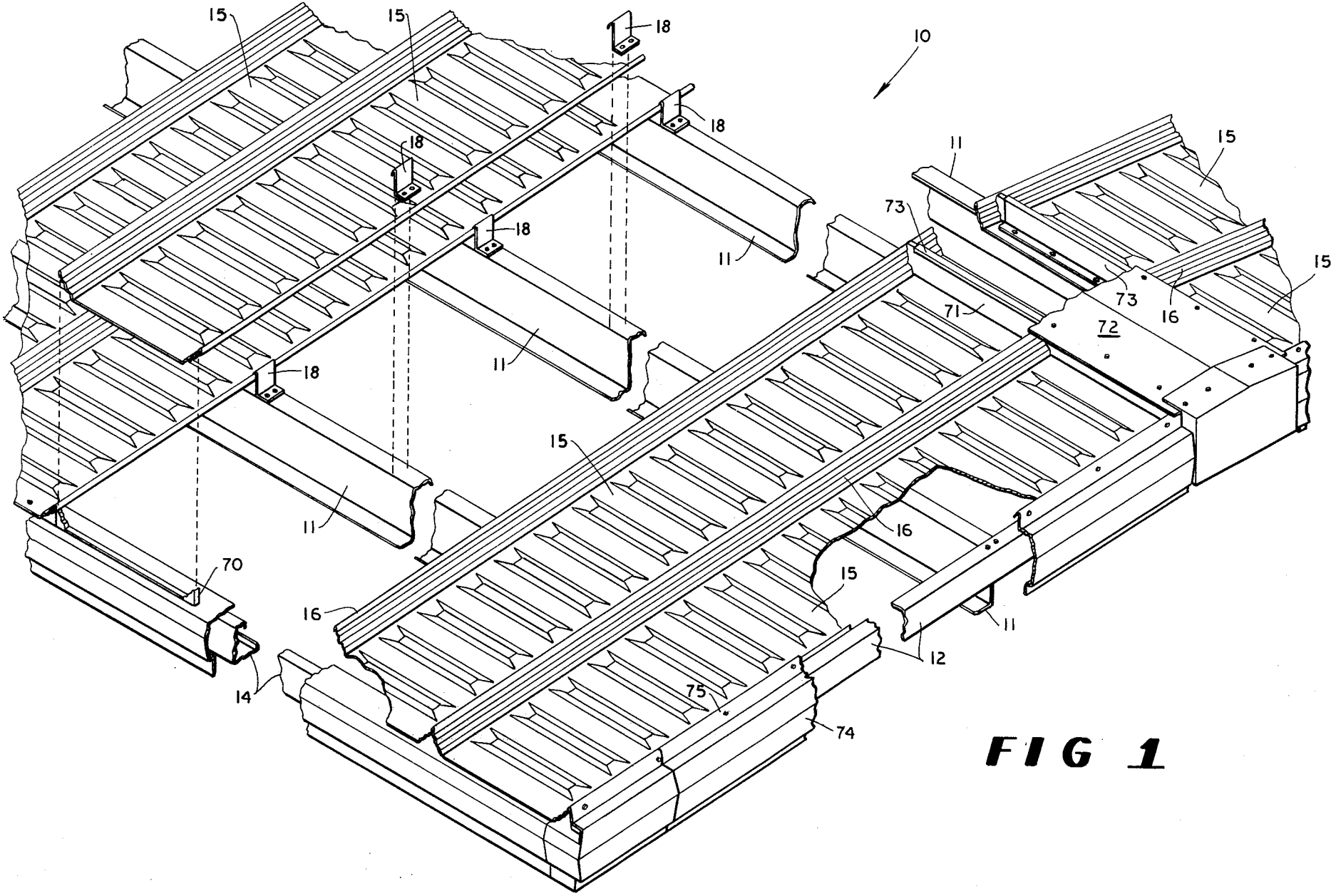
FIG. 1 is a perspective view of a portion of a roof utilizing a roof structure formed in accordance with the present invention.

Referring now more particularly to the drawings, and to that embodiment of the invention here chosen by way of illustration, FIG. 1 shows a building roof generally designated at numeral 10 including the structural members of the building which include purlins 11 connected at their ends by the gable angle member 12, and having an outside strut 14 as the eave strut. A plurality of standing rib roof panels 15 is shown placed across the purlins and having a standing rib 16 between each adjacent pair of panels 15. As shown by the exploded panel 15, it will be seen that the panels are held to the purlins by means of panel clips 18.

Figure 2:
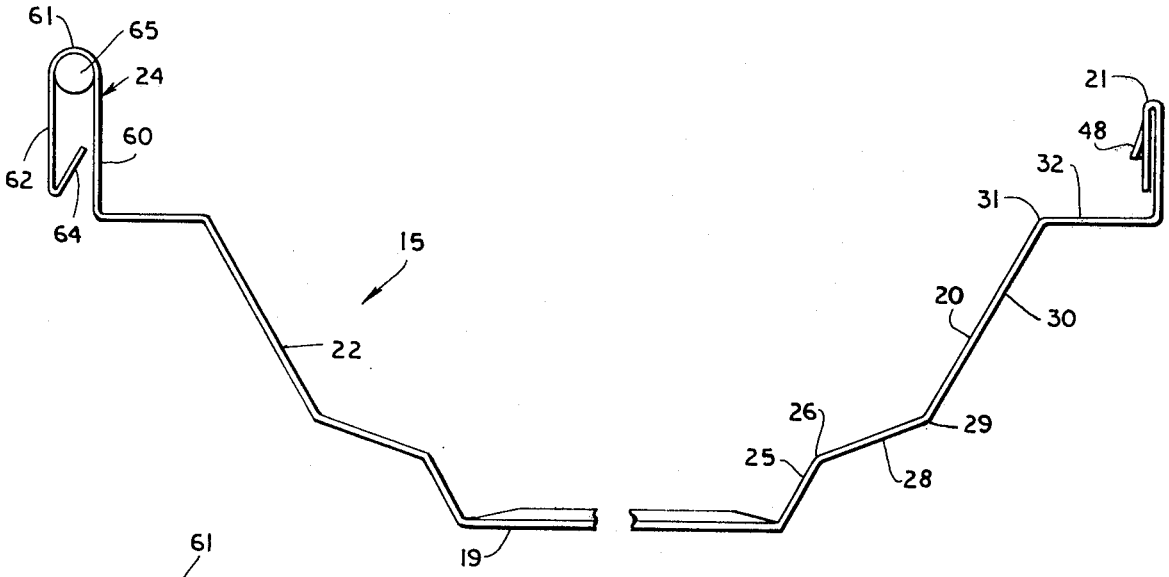
FIG. 2 is an end elevational view, partially broken away, of a roof panel formed in accordance with the present invention.

With this general discussion of the roof 10 in mind, attention is directed to FIG. 2 of the drawings which shows an end elevational view of one of the panels 15. It will be seen that the panel 15 includes a central web 19 having a raised edge 20 that terminates in a male locking member 21, and a parallel raised edge 22 that terminates in a female locking member 24. The raised edges 20 and 22 are mirror images of each other, each being designed to form one-half of the completed rib 16 on the roof 10. The raised edge 20 includes a first segment 25 tht is bent upwardly from the central web 19, the segment 25 ending in a longitudinal break 26 from which extends a second segment 28. The segment 28 is joined by a break 29 to another segment 30. Similarly, the segment 30 ends in a break 31 which leads to a horizontal portion 32; and, the male locking member 21 is bent from the segment 32 to stand vertically with respect to the central web 19.

As was previously mentioned, the raised edge 22 is a mirror image of the raised edge 20 so no detailed description of edge 22 is through to be necessary. It should be noted that the female locking member 24 is also vertically disposed with respect to the central panel 19 so that the female locking member 24 is parallel to the male locking member 21.

Figure 3:
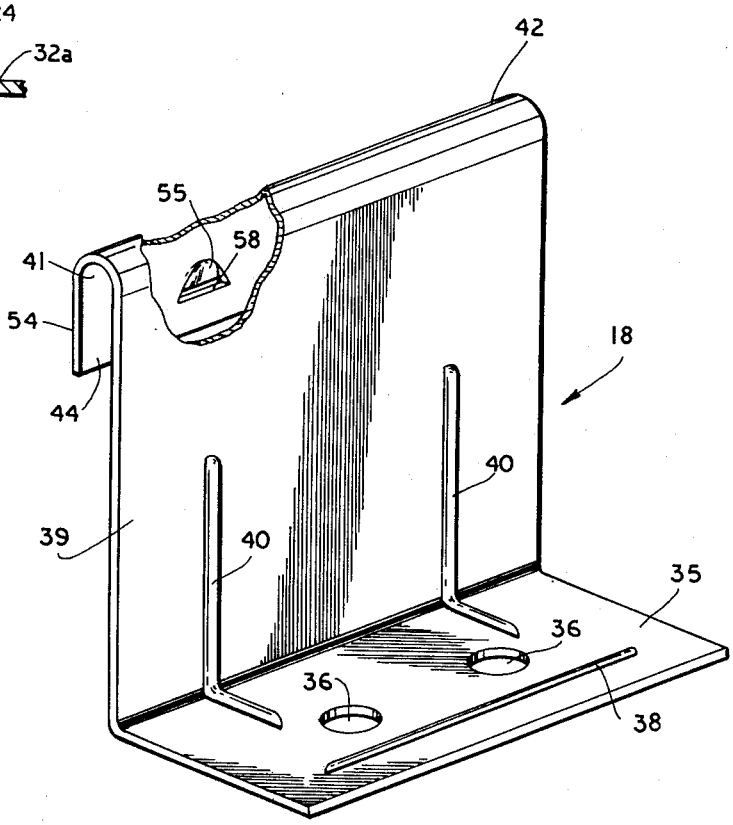
FIG. 3 is a perspective view of a panel clip for use with the panel shown in FIG. 2, portions thereof being broken away to show the structural details of the clip.

Looking now at FIG. 3 of the drawings, it will be seen that a panel clip 18 includes a base member 35 which has a pair of holes 36 therethrough for attachment of the base member 35 to a purlin 11 or other building structure. The base member 35 also includes a strengthening rib 38. Extending upwardly from the base member 35, the panel clip 18 has a body 39; and, extending from the body 39 and into the base member 35 there is a pair of gussets 40 that serve the dual function of both strengthening the body 39 and improving the rigidity between the base member 35 and the body 39.

The upper edge of the body 39 is formed with a return bend 41, the outside 42 of which acts as a secondary male locking member, and the inside 44 of which acts as a secondary female locking member. The panel clip 18 therefore provides what can be termed a hermaphroditic locking member to act in conjunction with panel members 15.

Figure 4:
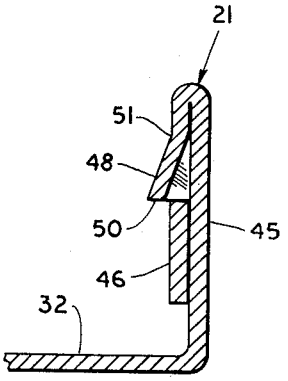
FIG. 4 is an enlarged cross-sectional view showing the male locking member of the panel illustrated in FIG. 2.
Figure 5:
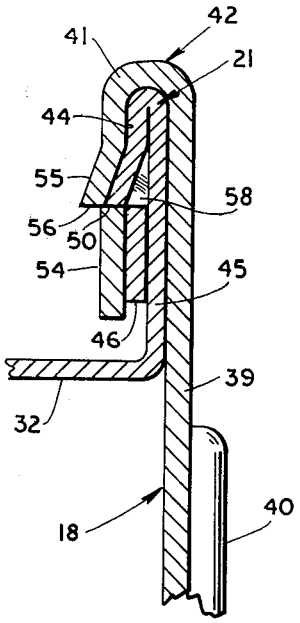
FIG. 5 is a view similar to FIG. 4 and showing the clip of FIG. 3 engaged with the male locking member.
Figure 6:
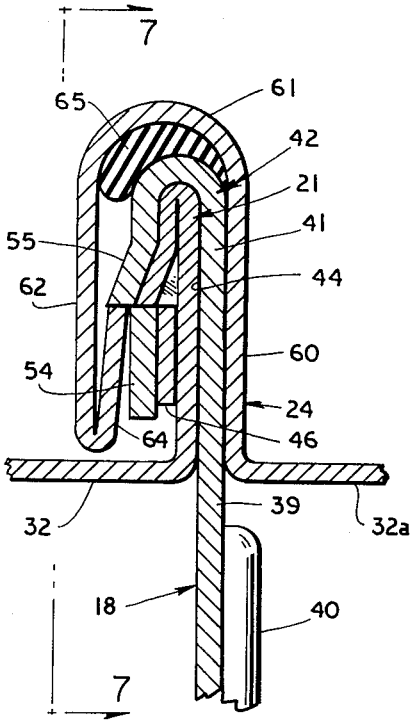
FIG. 6 is a view similar to FIG. 4 and showing the clip of FIG. 3 engaged between the male locking member and the female locking member of the panel shown in FIG. 2.

A better understanding of the locking member will be had by reference to FIGS. 4–6 of the drawings. Looking first at FIG. 4, it will be seen that the male locking member 21 includes a vertical flange 45 having a hem 46, the effect being that the edge of the sheet metal from which the panel 15 is formed is hemmed and the hem is substantially flattened to cause the hem 46 to lie flat against the flange 45. Spaced along the hem 46 there is a plurality of buttons 48.

Figure 7:
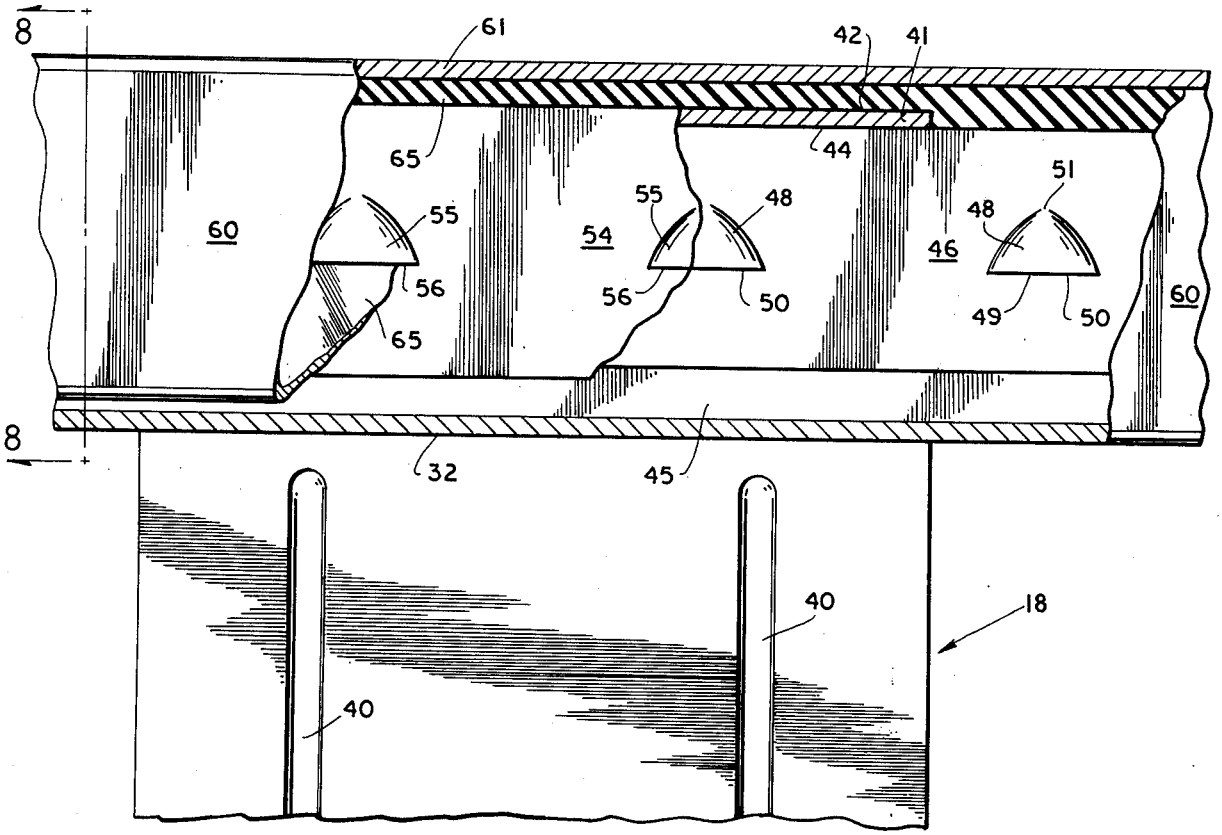
FIG. 7 is a cross-sectional view taken substantially along the line 7—7 of FIG. 6, the seam being broken away to reveal the structure thereof; and, FIG. 8 is a cross-sectional view taken substantially along the line 8—8 in FIG. 7.

The buttons 48 are punched from the hem 46 and are such that the metal is severed along a line 49, the metal then being pushed forward to produce the buttons 48. This results in a lower locking lip 50 on the button 48 with the material of the button 48 merging into the hem 46 at 51. As is seen in FIG. 7 of the drawings, the buttons 48 have a somewhat triangular appearance in elevational view with the locking lips 50 acting as the base of the triangle and being also the line 49 along which the metal is severed while the button 48 merges with the metal of the hem 46 on the other two sides. It should be understood that the precise shape of the button 48 is not important. The button is used simply as a means to provide the locking lips 50, so the button itself could be square, rectangular, trapezoidal or virtually any other shape.

FIG. 5 of the drawings shows the male locking member 21 as shown in FIG. 4, but shows a panel clip 18 engaged therewith. Looking at FIG. 5 (with reference also to FIG. 3) it will be seen that the return bend 41 of the panel clip 18 includes a flange 54 having a pair of locking buttons 55 punched therefrom. It will be seen that the buttons 55 are formed very similarly to the buttons 48; however, since the flange 54 is spaced from the body 39, it will be seen that both sides of the button 55 are utilized. The outside 42 of the return bend 41 is provided with a lower locking lip 56 due to the punching of the button 55, while the inside 44 of the return bend 41 is provided with a locking ledge 58. As is clearly shown in FIG. 5 of the drawings, the lower locking lip 50 of the male locking member 21 and the locking ledge 58 of the panel clip 18 are so dimensioned with respect to each other that the lower locking lip 50 will engage the locking ledge 58 of the panel clip 18 when the male locking member 21 is inserted into the female locking member 44 of the panel clip 18. Since the upper end of the panel clip 18 surrounds the uppermost edge of the male locking member 21, the member 21 cannot move upwardly with respect to panel clip 18; and, since the lower locking lip 50 of the button 48 is engaged with the locking ledge 58 of the panel clip, the member 21 cannot move down with respect to panel clip 18. It will therefore be seen that, once the male member 21 is engaged with the female member 44 of the panel clip 18 the two members cannot be separated except by totally destroying one or both of the panel 15 and the panel clip 18.

Referring next to FIG. 6 of the drawings and with reference to FIG. 2, it will be seen that the female locking member 24 is formed of a vertical flange 60 having a relatively wide radius return bend 61 resulting in a downwardly extending flange 62, the flange 62 terminating in an upwardly extending locking lip 64. Looking at FIG. 2 of the drawings, it will be seen that there is a continuous bead of mastic or other sealing material within the return bend 61, the sealing material being designated at 65.

With particular attention to FIG. 6 of the drawings, it will now be understood that the female locking member 24 is so dimensioned that the male locking member 42 of the panel clip 18 can be received within the return bend 61, and the mastic 65 will be deformed to conform to the upper end of the panel clip 18. With exertion of proper force on the uppermost edge of the locking member 24, the locking member 24 will be urged down until the locking lip 64 is received beneath the lower locking lip 56 of the panel clip 18. Once this condition is reached, as illustrated at FIG. 6, it will be seen that the entire seam is locked together so that it cannot be moved or taken apart without destruction of the panel members.

Figure 8:
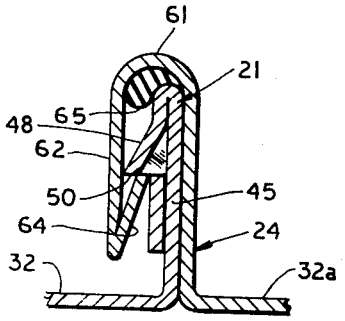

FIGS. 7 and 8 of the drawings show the interlocking of the female locking member 24 with the male locking member 21 without the intervention of the hermaphroditic locking member. It will be understood that the locking lip 64 of the member 24 is engageable with the lower locking lip 50 of the male locking member 21.

By way of example, the panels 15 can be made of 24 gauge steel, and the panel clips 18 can be made of 22 gauge steel. With the entire locking members 21 and 24 being approximately 1 inch high, it will be understood that a relatively large force will be required to distort the seam once put together. Furthermore, the buttons 48 on the male locking member 21 may be placed about 1½ inches apart along the complete length of a panel 15; then, the buttons 55 on the clip 18 can similarly be placed 1½ inches apart for proper mating. This will provide a large total locking area between the male and the female locking members for a very secure seam.

One important feature to note with respect to FIG. 6 is that, if a force is exerted downwardly on the portion 32*a*, the tendency would be only to urge the female locking member 24 into closer engagement with the panel clip 18. Since the panel clip 18 is substantially rigid and is fixed directly to the frame of the building, the seam formed will not be destroyed by such a force. Also, it will be seen that a force directed downwardly on the segment 32 of the panel will tend to pull the male locking member 21 out of the panel clip 18; however, since the lower locking edge 50 of each of the buttons 48 is firmly engaged with the locking ledge 58 of the buttons 55 on the panel clips 18, the force will again be transmitted to the panel clip 18, thence to the building frame.

Returning now primarily to FIG. 1 of the drawings, it should be understood that, in installing a plurality of the panels made in accordance with the present invention in order to form the roof, one would begin by installing a plurality of the panel clips 18, one panel clip 18 being secured to each of the purlins 11. With the panel clips 18 in place, the first panel 15 would be aligned with the panel clips so that the female locking member 24 can receive the male locking member 42 of the panel clip 18. With the first panel 15 in place, a second group of panel clips 18 would be installed on the purlins 11, and the male locking member 21 of the panel 15 would be inserted into the female locking member 44 of the panel clip 18. As soon as this is done, the next panel 15 would be placed over the panel clips 18, the female locking member 24 of the panel being engaged with the male locking member 42 of the panel clips 18, and with the male locking member 21 between the clips 18. This process would be continued until the entire roof 10 is covered with the panels 15. Obviously, the final member to be put into place would be a group of the panel clips 18 which would be attached to the ends of the purlins 11 to retain the final edge of the final panel 15.

As an alternative, since the edges of the adjacent panels are locked together by the locking members 21 and 24, the panel clip 18 can be constructed to omit the buttons 55. The clip 18 would still be formed to be receivable between the locking members 21 and 24, but the clip would not be interlocked by means of the buttons. The return bend 41 may be modified so that the lower edge of the flange 54 provides an equivalent of the lower locking lip 56 thereby producing a result similar to the result achieved by the buttons 55.

As shown in FIG. 1 of the drawings, there can very conveniently be provided an inside closure strip 70 designed simply to project upwardly into the standing rib 16 to close the space to the weather. Similarly, there can be an outside closure strip 71 for use in such locations as the ridge, where the ridge closure flashing 73 secures the closure strip 71. Also, the ridge flashing can be attached to the ridge closure flashing. The longitudinal edge of the panels 15, as previously mentioned, are formed as mirror images of each other; therefore, a rake flashing 74 can be provided to engage the upper edge of the rib 16 as at 75 and also to provide the flashing as is usual. Since both the edge 20 and the edge 22 are mirror images, a single flashing 74 can be used on both ends of the building.

It will therefore be seen that the roof structure of the present invention provides a very simple structure utilizing a single panel member 15 in conjunction with a panel clip 18. The panel 15 is so formed that it can be nested for storage and shipping to reduce the space to a minimum; yet, when a roof is formed of the panels 15 maximum coverage is obtained with each individual panel. While a particular embodiment of the invention has been here presented by way of illustration, it will be understood that such embodiment is illustrative only and is meant to be in no way restrictive; therefore, numerous changes and modifications may be made and the full use of equivalents resorted to without departing from the spirit or scope of the invention as defined by the appended claims.

We claim:

1. A standing rib roof structure for installation on the framing of a building including purlins for supporting said roof structure, said roof structure comprising a plurality of panels, each of said plurality of panels including: a first raised edge extending generally longitudinally of said panel, a male locking member carried on said first raised edge and arranged substantially perpendicularly to said panel to be substantially perpendicular to said purlins, a plurality of locking lips spaced along said male locking member and facing downwardly towards said purlins; a second raised edge extending generally longitudinally of said panel and parallel to said first raised edge, a female locking member carried on said second raised edge, said female locking member being arranged substantially perpendicularly to said panel to be substantially perpendicular to said purlins and substantially parallel to said male locking member, a locking lip extending along said female locking member and facing upwardly; said male locking member and said female locking member being so constructed and arranged that said female locking member is receivable over said male locking member through motion directed along said male locking member generally perpendicular to said purlins and said locking lip of said female locking member will be engaged under said locking lips of said male locking member; said roof structure further including a plurality of panel clips, each panel clip of said plurality of panel clips including a hermaphroditic locking member comprising a secondary female locking member for receiving said male locking member, a locking ledge facing upwardly for engaging one of said locking lips on said male locking member, and a secondary male locking member for being received within said female locking member, said secondary male locking member including a downwardly facing locking lip for engaging said locking lip on said female locking member, said panel clips being so constructed and arranged that said secondary female locking member is engageable with said male locking member through motion directed along said male locking member generally perpendicular to said purlins, and said female locking member is engageable with said secondary male locking member through motion directed along said secondary male locking member generally perpendicular to said purlins, said female locking member being engageable with said secondary male locking member both with and without said secondary locking member's being engaged with said male locking member.

2. A standing rib roof structure as claimed in claim 1, wherein said first raised edge on one of said plurality of panels and said second raised edge on another of said plurality of panels are interlocked by said male locking means received within said female locking means for forming a standing rib in said roof structure.

3. A standing rib roof structure as claimed in claim 2, and further including a sealing means within said female locking member, said sealing means comprising a bead of deformable material in said female locking member substantially co-extensive with said female locking member and engagable by said male locking member.

4. A roof structure including a plurality of panels for forming a standing rib roof, each panel of said plurality of panels comprising: a central web; a first raised edge along said central web longitudinally thereof, said first raised edge carrying a male locking member at the extremity thereof, said male locking member including a flange perpendicular to said web a hem juxtaposed on said flange and substantially coextensive therewith, a plurality of buttons spaced along said hem, each of said buttons having a lower locking lip; a second raised edge along said central web longitudinally thereof, said second raised edge carrying a female locking member at its extremity, said female locking member including a first flange perpendicular to said central web, said first flange having a return bend, a second flange provided by said return bend, and a locking lip, said locking lip extending upwardly from the lower edge of said second flange and inwardly of said return bend; said flange of said male locking member being parallel to said second flange of said female locking member, and equally spaced from said central web; and, said locking lip of said female locking member being on the same level as said lower locking lip of said male locking member and extending towards said first flange of said female locking member sufficiently to engage said hem of said male locking member when said male locking member is received within said female locking member; said roof structure further including a plurality of panel clips to secure said plurality of panels to a roof, each of said panel clips including a base fixable to the roof, a body extending from said base generally perpendicular to said central web, a return bend at the extremity of said body receivable between said female locking member and said male locking member while said male locking member is received within said female locking member, said locking lip being engageable with said return bend, said return bend at the extremity of said body providing a hermaphroditic locking member, said hermaphroditic locking member comprising a secondary female locking member formed interiorly of said return bend and including a locking ledge, and a secondary male locking member formed exteriorly of said return bend and including a lower locking lip coplanar with said locking edge.

5. A roof structure as claimed in claim 4, said plurality of buttons being equally spaced along said male locking member.

6. A roof structure as claimed in claim 5, and including a plurality of locking ledges on said hermaphroditic locking member, said plurality of locking ledges being spaced apart a distance substantially equal to the spacing between said plurality of buttons on said male locking member.

7. A roof structure as claimed in claim 6, and further including a sealing means within said female locking member, said sealing means comprising a bead of deformable material in said return bend of said female locking member and generally coextensive therewith, and engageable by said male locking member.

* * * * *